US006267182B1

(12) United States Patent
Lima

(10) Patent No.: US 6,267,182 B1
(45) Date of Patent: Jul. 31, 2001

(54) METHOD AND EQUIPMENT FOR OFFSHORE OIL PRODUCTION WITH PRIMARY GAS SEPARATION AND FLOW USING THE INJECTION OF HIGH PRESSURE GAS

(75) Inventor: Paulo C. R. Lima, Milton Keynes (GB)

(73) Assignee: Petroleo Brasileiro S. A. - Petrobras (BR)

( * ) Notice: Subject to any disclaimer, the term of this patent is extended or adjusted under 35 U.S.C. 154(b) by 0 days.

(21) Appl. No.: 09/202,323

(22) PCT Filed: May 1, 1997

(86) PCT No.: PCT/GB97/01200

§ 371 Date: May 20, 1999

§ 102(e) Date: May 20, 1999

(87) PCT Pub. No.: WO97/47855

PCT Pub. Date: Dec. 18, 1997

(30) Foreign Application Priority Data

Jun. 12, 1996 (BR) ..... 19602746

(51) Int. Cl.[7] ..... E21B 43/36

(52) U.S. Cl. ..... 166/335; 166/357; 166/267; 166/372; 166/369

(58) Field of Search ..... 166/257, 267, 166/266, 370, 372, 273, 369, 357, 360, 364, 368, 335

(56) References Cited

U.S. PATENT DOCUMENTS 3,113,620 * 12/1963 Hemminger ..... 166/257
3,486,297 * 12/1969 Eisinga et al. ..... 166/357 X
4,033,411 * 7/1977 Goins ..... 166/257
4,995,460 * 2/1991 Strahan ..... 166/267
5,044,440 9/1991 Stinessen et al. .
5,149,344 * 9/1992 Macy ..... 166/267 X
5,199,496 4/1993 Redus et al. .
5,232,475 * 8/1993 Jepson ..... 166/267 X
5,435,338 * 7/1995 Da Silva et al. ..... 137/242
5,441,365 * 8/1995 Duffney et al. ..... 166/267 X
5,460,227 10/1995 Sidrim .
6,129,150 * 10/2000 Lima ..... 166/357

FOREIGN PATENT DOCUMENTS 579 497 1/1994 (EP) .

* cited by examiner

*Primary Examiner*—David Bagnell
*Assistant Examiner*—John Kreck
(74) *Attorney, Agent, or Firm*—Nixon & Vanderhye PC

(57) ABSTRACT

A subsea primary separating vessel (2,22) is installed close to the wellhead (1,31) of an oil producing well to effect primary separation of the liquid and gas phases of the fluids produced. A line (3,23) connected to the top of the separating vessel allows separated gas to flow to a gathering vessel (8,28) located at any gathering center. At least one flow line (4,5,24) connects the lower part of the separating vessel to a vessel (9,29) located at any gathering center. When the volume of liquid phase which separates out within the at least one flow line begins to exert a back pressure which adversely affects production from the well, pressurized gas can be injected into the flow line(s) for a specific period of time in order to promote the flow of liquid gas to the vessel (9,29). If it is desired that flow efficiency should be increased a mechanical interface driven by the pressurized gas may be used to encourage flow of the liquid phase.

10 Claims, 2 Drawing Sheets

METHOD AND EQUIPMENT FOR OFFSHORE OIL PRODUCTION WITH PRIMARY GAS SEPARATION AND FLOW USING THE INJECTION OF HIGH PRESSURE GAS

This application is the national phase of international application PCT/GB97/01200 filed May 1, 1997 which designated the U.S.

Field of the Invention

This invention relates to a method and equipment to assist the flow, up to the surface, of hydrocarbon mixtures containing a high gas concentration. It may be applied to a single offshore oil well or to an undersea gathering line (manifold) which receives production from various wells for subsequent delivery.

In the flow of oil, as occurs in undersea production lines, large pressure head losses occur due mainly to the large simultaneous flows of gas and oil, and which give rise to great shear stresses in the flow.

In the technique of deep offshore production another factor which gives rise to high pressure gradients is the great difference in level between the wellhead and the platform, which very frequently makes it necessary to use extensive vertical pipes to deliver the products to the surface; such pipes are known to those skilled in the art as "risers".

These factors result in high pressures at the wellhead or in the undersea gathering line (manifold), significantly reducing production.

U.S. Pat. No. 5,460,227 discloses a subsea primary gas separation of the production of an offshore oil well, the use of a separated gas flow line to a gathering center, and a pressurization of the separated liquid to transport it to the gathering center.

U.S. Pat. No. 5,199,496 discloses the use of Bernoulli effect for transporting the fluid mixture of crude oil, water and gas to a gathering center.

EP-A-0579497 discloses pressurizing the gas in a separator to enhance both separation and transport of the separated liquid.

U.S. Pat. No. 5,044,440 discloses flowing production fluid form a well head to a subsea primary separator and separating out the liquid phase from that separator and compressing the separated gas phase to facilitate its transport.

Summary of the Invention

The object of this invention is to provide equipment and a method to assist flow of the multiphase production from an oil producing well to any gathering station.

It is a further object of this invention to promote the primary separation of the liquid and gas phases of fluids produced by an oil producing well and to encourage flow of these two separated phases along separate flow lines to a gathering station.

A subsea primary separating means is used to perform a primary separation between the liquid and gas phases right on the ocean bed. Where the separating means is a separating vessel the gas phase is carried away to the gathering station by a separated gas flow line connected to the top of the primary separating vessel and the liquid phase is carried by at least one flow line connected to the lower part of the primary separating vessel.

Pressurized gas is injected into the at least one flow line at intervals to encourage flow of the liquid phase settling out in this line to the gathering station.

The liquid phase is caused to flow to a gathering station through at least one flow line. At least one U-shaped pipe length connects the pressurized gas line to the at least one flow line so that pressurized gas can be injected into the at least one flow line for a required period of time.

This volume of pressurized gas makes it possible for the liquid phase which has collected in the at least one flow line to flow to the gathering center. A check valve installed in each of the at least one flow line prevents the pressurized gas from entering the primary separating means.

If it is desired to increase the flow efficiency, a mechanical interface may be used to push the liquid phase separating out in the at least one flow line to the gathering center. In this case the pressurized gas line must be provided with means to allow the mechanical interface to be inserted at the launching point and with means to allow the mechanical interface to travel along within the pressurized gas line and into the flow line. The flow line must in turn have means to receive the mechanical interface without interrupting production.

Thus one aspect of the present invention provides equipment for offshore oil production with primary gas separation and flow, by means of pressurized gas injection comprising: a subsea primary separating means which receives the production from an offshore oil well delivered from a wellhead through a wellhead flow line; a separated gas flow line which connects the upper part of the primary separating means to a collecting vessel located at a gathering center; at least one flow line which connects the lower part of the subsea primary separating means to a gathering center; wherein at least one U-shaped pipe length which is fitted with a shut-off valve and connects said at least one flow line to a pressurized gas line which is fitted with a pressurized gas check valve near to the point where the pressurized gas line connects to the wellhead to avoid back flow of gas originating from the annulus of the well; wherein said at least one flow line has a check valve located between the subsea primary separating means and the point of connection to said at least one U-shaped pipe length in order to prevent the injected pressurized gas from exerting a back pressure which would adversely affect production from the oil producing well.

The separated gas flow line may include a pressure control valve, which makes it possible to control the level of the liquid phase of fluid produced which collects in the subsea primary separating means.

If it is necessary to remove any accumulations of condensate within the separated gas flow line for the separated gas, the pressurized gas line can be connected to it, this making it possible for a traveling mechanical interface device, which causes the condensed fluids to flow to the gathering station, to pass through the separated gas flow line. In this case the shut-off valve in the at least one U-shaped pipe length must be a clear-flow shut-off valve, and a check valve must be fitted to prevent the pressurized gas from passing into the primary separating means.

Another aspect of the invention provides a method for offshore oil production with primary gas separation and flow by the injection of pressurized gas comprising the following steps:

- allowing fluids produced by a well to flow through a wellhead flow line from a wellhead to a subsea primary separating means where primary separation between liquid and gas phases takes place;
- the liquid phase separates out in the bottom part of the subsea primary separating vessel and also accumulates in an outlet flow line and in first and second flow lines;

as the liquid phase accumulates in the lengths of the flow line which are horizontal or have only a small gradient, the back pressure exerted by that volume of fluids on the production from the well will be small;

injecting pressurized gas along a gas injection line to cause flow, to a gathering center, of the liquid phase which has accumulated in outlet, first and second flow lines;

wherein it further comprises the following steps:

when the back pressure exerted by the volume of fluids accumulated in the outlet flow line and in the first and second flow lines begins to increase and to adversely affect production from the well, then a shut-off valve among first and second shut-off valve respectively located in second and third U-shaped pipe length which connects the pressurized gas line to first and second flow lines opens for a predetermined period so as to allow a volume of pressurized gas to pass into that flow line among first and second flow line connected to the U-shaped pipe length among second and third U-shaped pipe length where a shut-off valve among first and second shut-off valve has been opened;

a check valve among first and second valves fitted in respective first and second flow line close to the point of connection between each of said first and second flow lines and respective second and third U-shaped pipe length prevents the injected pressurized gas from exerting any back pressure which affects the production of the well;

the injected pressurized gas then promotes flow of the liquid phase which has accumulated in flow line among first and second flow line connected to the U-shaped pipe length among second and third U-shaped pipe length where a shut-off valve among first and second shut-off valve has been opened to the gathering center;

after closing of the shut-off valve among first and second shut-off valve which was previously open the liquid phase will again accumulate in the flow line among first and second flow lines into which the pressurized gas was injected, thus completing performance of the method.

BRIEF DESCRIPTION OF THE DRAWINGS

The characteristics of this invention will be better understood from the following detailed description, which is given merely by way of example, taken together with the associated drawings which are referred to below and which form an integral part of this description.

DESCRIPTION OF PREFERRED EMBODIMENTS

Figure 1:
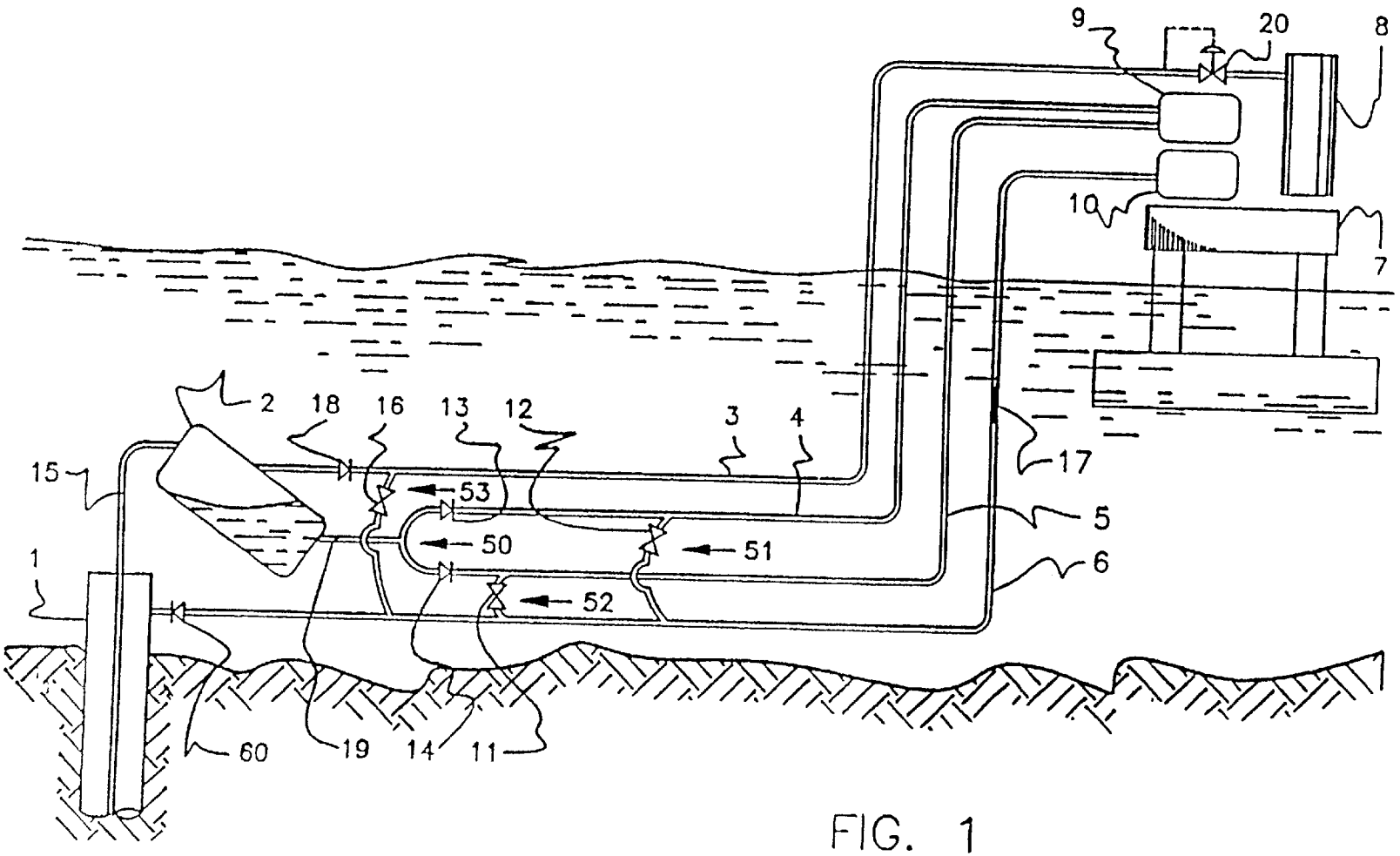
FIG. 1 is a diagrammatic representation of an application of the method and equipment according to this invention in which two lines are used for the delivery of the production flow.

FIG. 1 shows a diagrammatic representation of an embodiment of the equipment according to this invention, in which two lines 4 and 5 are used to effect flow of the liquid phase of the fluids produced by an offshore oil well to a gathering center. In this embodiment the fluids are collected in a surge tank 9 located on a platform 7 serving as the gathering center.

A wellhead 1 of an offshore well is connected through a wellhead flow line 15 to the top of an undersea separating means, shown in FIG. 1 as a subsea primary separating vessel 2, the function of the separating means being to effect primary separation of the liquid and gas phases of the fluids produced by the offshore oil well.

A pressurized gas line 6 connects an annulus of the offshore well to a compressed gas supply system 10, which in this embodiment is located on a platform 7. A pressurized gas check valve 60 is fitted in the pressurized gas line 6, close to the wellhead 1. The purpose of this pressurized gas check valve is to avoid any back flow of gas leaving the annulus.

The pressurized gas line 6 is normally used to inject gas used for the artificial lifting of the produced fluids into the annulus of a production well, a technique known by those skilled in the art as gas lift.

An outlet flow line 19 connects the lower part of the subsea primary separating vessel 2 to a gathering device which in this embodiment is a first U-shaped pipe length 50 which has one of its ends connected to a first flow line 4 and the other connected to a second flow line 5. First and second flow lines 4 and 5 have first and second check valves 13 and 14 respectively fitted close to the points of connection with the first U-shaped pipe length 50.

A separated gas flow line 3 is connected to the top of the subsea primary separating vessel 2, and this separated gas line 3 is also connected to a collecting vessel 8 which in this embodiment is located on the platform 7. The gas which separates out in the subsea primary separating vessel 2 should preferably pass through this separated gas flow line 3.

A pressure control valve 20 fitted in separated gas flow line 3 will also be seen in FIG. 1. This pressure control valve 20, which is optional and may be located at any point in the line, is designed to control the flow of separated gas to the collecting vessel 8 in accordance with parameters determined by the operating conditions.

A second U-shaped pipe length 51, which is fitted with a first shut-off valve 12, connects the pressurized gas line 6 to the first flow line 4. A third U-shaped pipe length 52 which is fitted with a second shut-off valve 11 connects pressurized gas line 6 to second flow line 5.

FIG. 1 also shows a fourth U-shaped pipe length 53 which also has a third shut-off valve 16 and connects the pressurized gas line 6 to the separated gas flow line 3. Its use is optional, as will be shown below. If it is used, then a separated gas check valve 18 must be fitted in the separated gas flow line 3 near to the point where it connects with the fourth U-shaped pipe length 53.

The method for the use of the embodiment of the invention according to FIG. 1 is described below step by step:

a) The second and first shut-off valves 11, 12 of the second and third U-shaped pipe lengths 51, 52, which connect first and second flow lines 4, 5 to pressurized gas line 6 are closed;

b) The fluids produced by the well flow through the wellhead flow line 15 from wellhead 1 to the subsea primary separating vessel 2 where primary separation between the liquid and gas phases takes place;

c) The liquid phase separates out in the bottom part of the subsea primary separating vessel 2 and also accumulates in the outlet flow line 19 and in the first and second flow lines 4, 5. As the liquid phase accumulates in the lengths of the flow line which are horizontal or have only a small gradient, the back pressure exerted by that volume of fluids on the production from the well will be small, d) When the back pressure exerted by the volume of fluids accumulated in the outlet flow line 19 and in the first and second flow lines 4, 5 begins to increase and to adversely affect production from the well, then a shut-off valve among first and second shut-off valve 12, 11 respectively located in second and third U-shaped pipe length 51, 52, which connects the pressurized gas line 6 to first and second flow lines 4, 5, opens for a predetermined period so as to allow a volume of pressurized gas to pass into that flow line among first and second flow line 4, 5 connected to the U-shaped pipe length among second and third U-shaped pipe length 51, 52 where a shut-off valve among first and second shut-off valve 12, 11 has been opened;

e) A check valve among first and second valves 13, 14 fitted in respective first and second flow line 4, 5 close to the point of connection between each of said first and second flow lines 4, 5 and respective second and third U-shaped pipe length 51, 52 prevents the injected pressurized gas from exerting any back pressure which affects the production of the well.

f) The injected pressurized gas then promotes flow of the liquid phase which has accumulated in flow line among first and second flow line 4, 5 connected to the U-shaped pipe length among second and third U-shaped pipe length 51, 52 where a shut-off valve among first and second shut-off valve 12, 11 has been opened to the gathering center, g) After closing of the shut-off valve among first and second shut-off valve 12, 11 which was previously open the liquid phase will again accumulate in the flow line among first and second flow lines 4, 5 into which the pressurized gas was injected, thus completing performance of the method.

Figure 2:
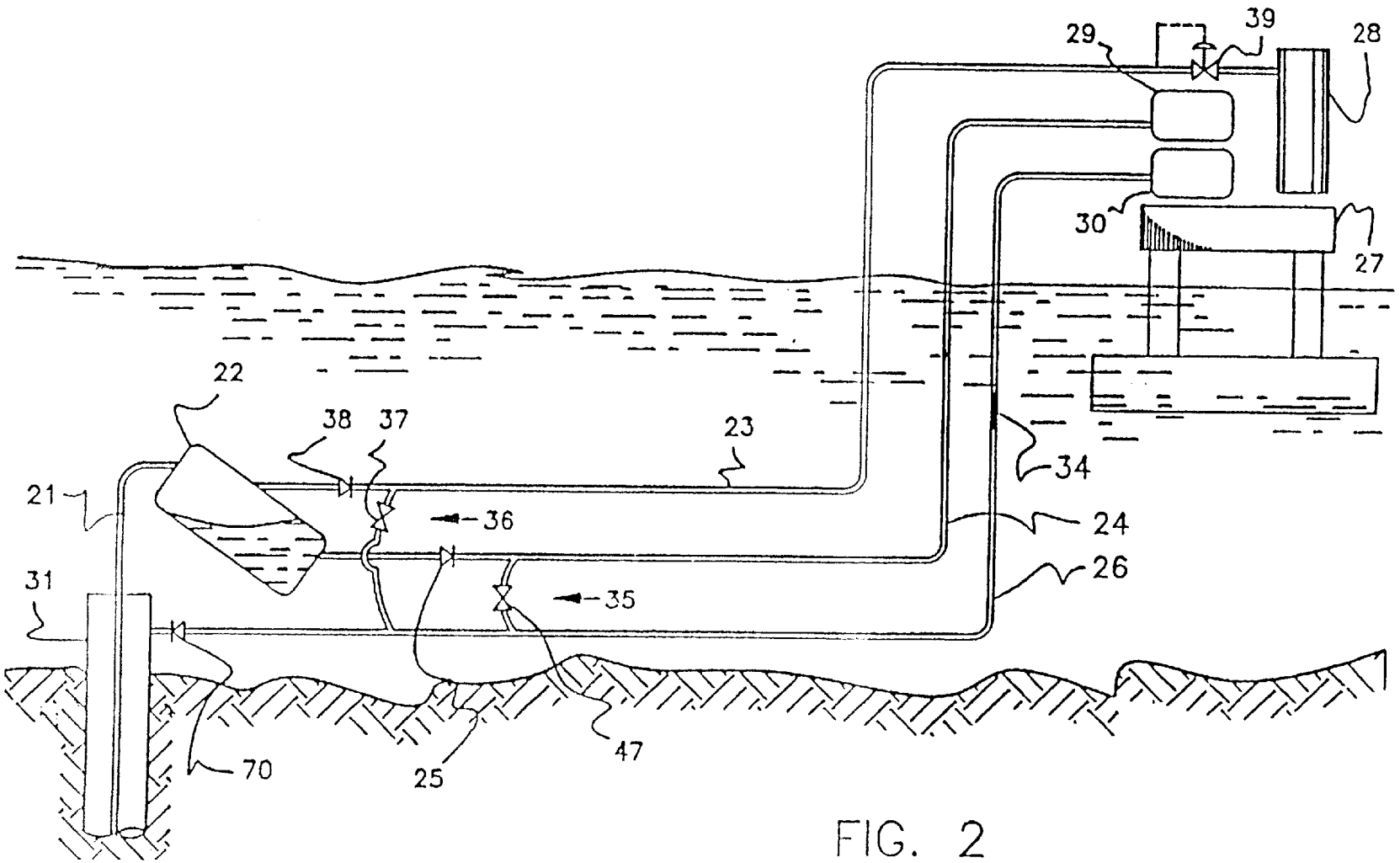
FIG. 2 is a diagrammatic representation of the method and equipment according to this invention in which a single line is used for delivery of the production flow.

FIG. 2 shows a diagrammatic representation of another embodiment of the equipment according to this invention, in which only one flow line 24 is used to encourage flow, to a gathering center, of the liquid phase of the fluids produced by an offshore oil well. In this embodiment the fluids are collected by a surge tank 29 located on a platform 27.

A wellhead 31 is connected by a wellhead flow line 21 to the top of a subsea separating means, which is shown in the FIG. 2 as a subsea primary separating vessel 22 and whose function is to promote primary separation of the liquid and gas phases of the fluids produced by the offshore oil well.

A pressurized gas line 26 connects an annulus of the offshore well to a compressed gas supply system 30, which in this embodiment is located on platform 27. A pressurized gas check valve 70 is fitted to pressurized gas line 26 close to the wellhead 31. The function of this pressurized gas check valve is to avoid any back flow of gas from the annulus.

As in the previous embodiment, the pressurized gas line 26 is normally used to inject gas which is used for artificial lifting of the produced fluids into the annulus of the producing well.

The flow line 24 connects the bottom part of subsea primary separating vessel 22 to surge tank 29.

The top of the subsea primary separating vessel 22 is connected to a separated gas flow line 23, which is in turn connected to a collecting vessel 28, which in this embodiment is located on the platform 27. Gas which separates out in the subsea primary separating vessel 22 should preferably pass through this separated gas flow line 23.

FIG. 2 also shows a pressure control valve 39 fitted to the separated gas flow line 23. This valve, which is optional, may be located at any point in the line and is used to control the flow of separated gas to the collecting vessel 28 in accordance with parameters previously defined by the operating conditions.

A first U-shaped pipe length 35, which is fitted with a first shut-off valve 47, connects the pressurized gas line 26 to the flow line 24.

A second U-shaped pipe length 36, which also has a second shut-off valve 37, connects the pressurized gas line 26 to the separated gas flow line 23. Its use is optional, as will be shown below. If it is used, a separated gas check valve 38 must then be fitted to separated gas flow line 23 close to the point of connection with second U-shaped pipe length 36.

The method for the use of the embodiment of the invention according to FIG. 2 is described below step by step:

a) The first shut-off valve 47 of the first U-shaped pipe length 35, which connect flow line 24 to pressurized gas line 26 is closed;

b) The fluids produced by the well flow through the wellhead flow line 21 from wellhead 31 to the subsea primary separating vessel 22 where primary separation between the liquid and gas phases takes place;

c) The liquid phase separates out in the bottom part of the subsea primary separating vessel 22 and also accumulates in the flow line 24. As the liquid phase accumulates in the lengths of the flow line which are horizontal or have only a small gradient, the back pressure exerted by that volume of fluids on the production from the well will be small, d) When the back pressure exerted by the volume of fluids accumulated in the flow line 24 begins to increase and to adversely affect production from the well, then the first shut-off valve 47 of the first U-shaped pipe length opens for a predetermined period so as to allow a volume of pressurized gas to pass into flow line 24; a check valve 25 fitted in the flow line 24 close to the point of connection between this flow line 24 and the first U-shaped pipe length 35 prevents the injected pressurized gas from exerting any back pressure which affects the production of the well;

e) The injected pressurized gas then promotes flow of the liquid phase which has accumulated in flow line 24 to the gathering center;

f) After closing of the first shut-off valve the liquid phase will again accumulate in the flow line 24, thus completing performance of the method.

One possibility for increasing the efficiency of flow of the liquid phase driven by the pressurized gas is to use a mechanical interface (17—FIG. 1) (34—FIG. 2) to prevent direct contact between the pressurized gas and the liquid phase, because this direct contact of two miscible fluids can cause a reduction in the volume delivered.

If such mechanical interfaces are used, means must be used to launch and to receive these interfaces at the location where they are maneuvered into position. These means are not described here as they do not form an integral part of the invention and also because they are widely known to those skilled in the art.

It is also necessary that means must also be used to allow passage of such a mechanical interface from the pressurized gas line to the U-shaped pipe length into which it must travel. Merely by way of example it is suggested in this situation that the device disclosed in WO-97/39273 should be used. Nevertheless, any other type of device which satisfactorily performs the task may be used.

FIG. 1 shows a mechanical interface 17 within the pressurized gas line 6. Likewise, in FIG. 2 a mechanical interface 34 may be seen in the pressurized gas line 26.

In case a mechanical interface is used, the shut-off valves into which the mechanical interface passes must be a clear-flow shut-off valve. The term clear-flow valve is intended to denote a valve which, when fully open, can pass a mechanical interface or pig therethrough.

As such, first, second and third shut-off valves (12, 11 and 16) of the embodiment according to FIG. 1, and first and second shut-off valves (47 and 37) of the embodiment according to FIG. 2 must be clear-flow shut-off valves for a mechanical interface to pass therethrough.

The use of more than one flow line to deliver liquid phase to the gathering center, as illustrated in the embodiment proposed in FIG. 1, has the advantage that it allows the liquid phase to accumulate at all times in at least one of the flow lines while the other (or others) is (are) receiving injected pressurized gas, and vice versa. It will be understood that the limiting number of flow lines used will be determined by geometrical reasons (space) and economic reasons (cost/benefit ratio).

This feature makes it possible to use a smaller primary separating vessel because, if only one flow line is used as in the embodiment proposed in FIG. 2, the primary separating vessel will have to be dimensioned to have the capacity to accept the extra volume of produced fluids which will be prevented from flowing along the flow line during the period while the flow line is pressurized by the injected pressurized gas.

It is recommended that the optional pressure control valve (20—FIG. 1) (39—FIG. 2) should be fitted in the separated gas flow line (3—FIG. 1) (23—FIG. 2). This valve makes it possible to control, in accordance with previously determined limits, the level of the liquid phase of the produced fluid accumulating in the subsea primary separating vessel (2—FIG. 1) (22—FIG. 2) because the valve opens or closes, depending on whether the gas pressure increases or decreases, this making it possible to keep the level of the fluid phase in the subsea primary separating vessel (2—FIG. 1) (22—FIG. 2) within desirable limits.

There is always the possibility that the separation of the liquid and gas phases which occurs inside the subsea primary separating vessel (2—FIG. 1) (22 FIG. 2) is incomplete, or that separating out of the liquid phase occurs as a result of special flow conditions when the separated gas is subsequently passing through the separated gas flow line (3—FIG. 1) (23—FIG. 2).

In such circumstances it is desirable that this liquid phase should be removed, because it causes serious problems. It is therefore suggested that a U-shaped pipe length (fourth U-shaped pipe length 53—FIG. 1) (second U-shaped pipe length 36—FIG. 2) should be fitted to connect the pressurized gas line (6—FIG. 1) (26 FIG. 2) to separated gas flow line (3—FIG. 1) (23—FIG. 2) which makes it possible to launch into that flow line a traveling mechanical interface device driven by pressurized gas, in order to remove liquid phase from the inside of the separated gas flow line. Merely by way of example the device disclosed in EP-A-0581616 may be used for this purpose.

If the length of pipe mentioned in the foregoing paragraph is used it will be necessary to fit a separated gas check valve (18—FIG. 1) (38—FIG. 2) between the subsea primary separating vessel (2—FIG. 1) (22—FIG. 2) and the point at which the U-shaped pipe length (fourth U-shaped pipe length 53—FIG. 1) (second U-shaped pipe length 36—FIG. 2) connects with the separated gas flow line (3—FIG. 1) (23—FIG. 2), to prevent pressurized gas from passing into the primary separating vessel (2—FIG. 1) (22—FIG. 2).

It is pointed out that in this situation it will also be necessary to have means for launching and receiving the traveling interface devices at the location where they are manoeuvered into position. It will also be necessary to have devices which will allow the mechanical interface to pass from the pressurized gas line to the U-shaped pipe length as already described previously.

It is important to note that when the gas which has separated out in the subsea primary separating vessel (2—FIG. 1) (22—FIG. 2) reaches the surface it is available for use as a raw material for the gas compression process which is used to remove the liquid phase from the flow lines, and this makes the process typically cyclical and easy to control.

In the embodiments illustrated in FIGS. 1 and 2 it is suggested that the gathering center for the produced fluids, the separated gas gathering vessel, and the gas compression system are concentrated at a single location, namely on a platform. This example is however merely indicative, as these installations may be located anywhere else, and may or may not be concentrated at a single point. Thus the location suggested for these installations in this description cannot in any way be regarded as a factor restricting the invention.

What is claimed is:

1. An apparatus for offshore oil production with primary gas separation and flow, by means of high pressure gas injection, comprising:

a subsea primary separator receiving a production from an offshore oil well delivered from a wellhead through a flow line;

a separated gas flow line connecting an upper part of said primary separator to a collecting vessel located at a gathering center;

at least one flow line connecting a lower part of said subsea primary separator to a gathering center;

a pressurized gas line which connects an annulus of the offshore well to a compressed gas supply system;

at least one U-shaped pipe length, which is fitted with a shut-off valve, connecting said at least one flow line to said pressurized gas line;

said pressurized gas line being fitted with a pressurized gas check valve near a point where said pressurized gas line connects to said wellhead so as to avoid back flow of gas originating from the annulus of said oil well; and wherein each said at least one flow line has a check valve located between said subsea primary separator and the point of connection to said at least one U-shaped pipe length in order to prevent the injected pressurized gas from exerting a back pressure which would adversely affect production from said oil producing well.

2. The apparatus recited in claim 1, further comprising:

a further U-shaped length of pipe having a clear-flow shut-off valve for connecting said high pressure gas line to said separated gas flow line and which allows a travelling mechanical interface driven by high pressure gas to pass from said high pressure gas line to said separated gas flow line for removing any liquid phase which may have separated out within said separated gas flow line; and wherein a check valve is fitted in said separated gas flow line close to a point of connection with said further U-shaped pipe length.

3. The apparatus recited in claim 2, further comprising a pressure control valve provided in said separated gas flow line for allowing control of gas pressure in said separated gas flow line.

4. The apparatus recited in claim 1, further comprising a pressure control valve provided in said separated gas flow line for allowing control of gas pressure in said separated gas flow line.

5. The apparatus according to claim 1,wherein said shut-off valve is a clear-flow shut-off valve.

6. The apparatus according to claim 1, wherein a pressure control valve is provided in the separated gas flow line in order to allow control of the pressure of the gas in that flow line.

7. A method for offshore oil production with primary gas separation and flow, by the injection of high pressure gas, comprising the steps of:

allowing fluids produced by an oil well to flow through a flow line from a wellhead to a subsea primary separator where a primary separation between a liquid phase and a gas phase takes place;

separating out said liquid phase in a lower part of said subsea primary separator and also allowing it to accumulate in an outlet flow line and in first and second flow lines, so that liquid phase accumulates in the lengths of said outlet, first and second flow lines which are horizontal or have only a small gradient; and injecting high pressure gas along a gas injection line to cause a flow to a gathering center of the liquid phase which has accumulated in at least one of said outlet, first and second flow lines;

wherein the injecting step comprises the following steps:

opening a shut-off valve among first and second shut-off valves respectively located in first and second U-shaped pipe lengths which respectively connect the gas injection line to said first and second flow lines for a predetermined period when a back pressure exerted by the volumes of fluid accumulated in the outlet flow line and in the first and second flow lines begins to increase and to adversely affect production from the well, so as to allow a volume of pressurized gas to pass into said respective flow line;

preventing the injected pressurized gas from exerting back pressure which affects the production of the well with a check valve fitted in said respective flow line close to the point of connection between said respective flow line and said respective U-shaped pipe length;

flowing the liquid phase, which has accumulated in said respective flow line to the gathering center;

closing of the shut-off valve among said first and second shut-off valves; and accumulating the liquid phase in the flow line among said first and second flow lines into which the pressurized gas was injected.

8. A method according to claim 7, wherein said shut-off valves are clear-flow shut-off valves and wherein said injecting step further comprises releasing a mechanical interface into said respective flow line among said first and second flow lines to prevent direct contact between said volume of pressurized gas and the liquid phase; and driving said mechanical interface with said volume of pressurized gas to cause the fluid phase in said respective flow line to flow to the gathering center.

9. A method for offshore oil production with primary gas separation and flow, by the injection of pressurized gas, comprising the following steps:

closing a first shut-off valve of a first U-shaped pipe length, which connects a flow line to a pressurized gas line;

flowing fluids produced by a well through a wellhead flow line from a wellhead to a subsea primary separating vessel where primary separation between liquid and gas phases takes place;

separating out the liquid phase in the bottom part of the subsea primary separating vessel;

accumulating the liquid phase in the flow line, wherein as the liquid phase accumulates in the lengths of the flow line which are horizontal or have only a small gradient;

injecting pressurized gas along said pressurized gas line to cause flow, to a gathering center, of the liquid phase which has accumulated in the flow line;

wherein the injecting step further comprises the following steps:

opening the first shut-off valve of the first U-shaped pipe length for a predetermined period when the back pressure exerted by the volume of fluid accumulated in the flow line begins to increase and to adversely affect production from the well, so as to allow a volume of pressurized gas to pass into the flow line;

preventing the injected pressurized gas from exerting any back pressure which affects the production from the well with a check valve fitted in the flow line close to the point of connection between the flow line and the first U-shaped pipe length;

promoting flow of the liquid phase which has accumulated in the flow line to a gathering center with the injected pressurized gas;

closing of the first shut-off valve; and accumulating the liquid phase in the flow line into which the pressurized gas was injected.

10. A method according claim 9, wherein said shut-off valve is a clear-flow shut-off valve and wherein said injecting step further comprises releasing a mechanical interface into the flow line to prevent direct contact between said volume of pressurized gas and the liquid phase; and driving said mechanical interface with said volume of pressurized gas to cause the fluid phase into the flow line to flow to the gathering center.

* * * * *